US006683282B2

(12) United States Patent
McMahon et al.

(10) Patent No.: US 6,683,282 B2
(45) Date of Patent: Jan. 27, 2004

(54) FOOD MERCHANDISER AND TEMPERATURE CONTROL SYSTEM

(75) Inventors: J. Patrick McMahon, Keosauqua, IA (US); Timothy L. McMahon, Keosauqua, IA (US); William J. Carter, Keosauqua, IA (US); Robert Nai Hon Mak, Arnold, MO (US)

(73) Assignee: Barker Company, Keosauqua, IA (US)

( * ) Notice: Subject to any disclaimer, the term of this patent is extended or adjusted under 35 U.S.C. 154(b) by 0 days.

(21) Appl. No.: 10/077,473

(22) Filed: Feb. 15, 2002

(65) Prior Publication Data

US 2002/0166462 A1 Nov. 14, 2002

Related U.S. Application Data

(63) Continuation of application No. 09/633,405, filed on Aug. 7, 2000, now abandoned.

(51) Int. Cl.[7] ..... F21V 7/00

(52) U.S. Cl. ..... 219/419; 219/400

(58) Field of Search ..... 219/419, 716, 219/385, 387, 400; 307/71; 165/12; 364/571.01; 99/331

(56) References Cited

U.S. PATENT DOCUMENTS 6,259,065 B1 7/2001 Hohler et al.

*Primary Examiner*—Sang Y. Paik
*Assistant Examiner*—Leonid M Fastovsky
(74) *Attorney, Agent, or Firm*—Suelthaus & Walsh, P.C.

(57) ABSTRACT

A display case or food merchandiser for displaying and serving hot food items or other products, has one or more long wave, infrared emitting heating elements. The voltage, and therefore the output, of the heating elements is controlled by a solid state percentage controller.

24 Claims, 18 Drawing Sheets

| | 4 HOT DOME | 6 HOT DOME | 8 HOT DOME |
|---|---|---|---|
| Designed Operating Temp. | 150F - 170F | 150F - 170F | 150F - 170F |
| Voltage | 208-3-60 | 208-3-60 | 208-3-60 |
| Lights | Wattage: 150 | Wattage: 150 | Wattage: 150 |
| Number of Lights | 2 | 3 | 4 |
| Well Heaters | Wattage: 1000 | Wattage: 1000 | Wattage: 1000 |
| Number of Well Heaters | 3 | 5 | 7 |
| Top Heaters | Wattage: 500 | Wattage: 500 | Wattage: 500 |
| Number of Heaters | 1 | 1 | 2 |
| Total Amperes | 13.45 | 20.4 | 29.3 |

| | PT-4R | PTD-6R | PTD-8R | PTD-10R | PTD-12R |
|---|---|---|---|---|---|
| VOLTS | 120-1-60 | 120-1-60 | 120-1-60 | 120-1-60 | 120-1-60 |
| AMPS | 1.04 | 1.59 | 2.57 | 3.12 | 3.72 |
| BTU'S | 3750 | 5670 | 7560 | 9450 | 11340 |
| EVAP. TEMP. | 18F | 18F | 18F | 18F | 18F |

OBSERVED PERFORMANCE MAY VARY 10
12
14
50
52
56
58

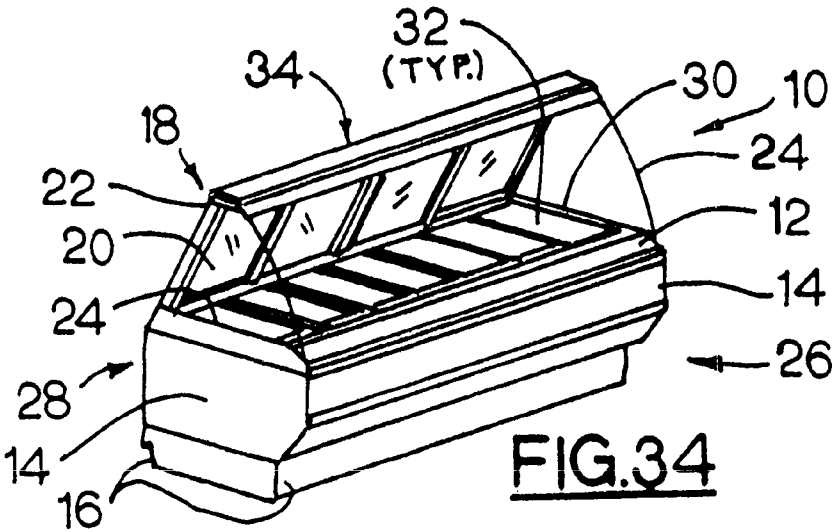

FIG.34

| | BMD 4-HOT | BMD 6-HOT | BMD 8-HOT |
|---|---|---|---|
| | Power Supply #2 | Power Supply #2 | Power Supply #2 |
| Designated Operating Temp. | 150-170F | 150-170F | 150-170F |
| | Voltage: 208-3-60 | Voltage: 208-3-60 | Voltage: 208-3-60 |
| Well Heaters | Wattage: 811 | Wattage: 811 | Wattage: 811 |
| Number of Well Heaters | 3 | 5 | 7 |
| Top Heaters | Wattage: 282 | Wattage: 282 | Wattage: 282 |
| Number of Heaters | 2 | 2 | 4 |
| Total Amps | 10.25 | 15.8 | 22.01 |

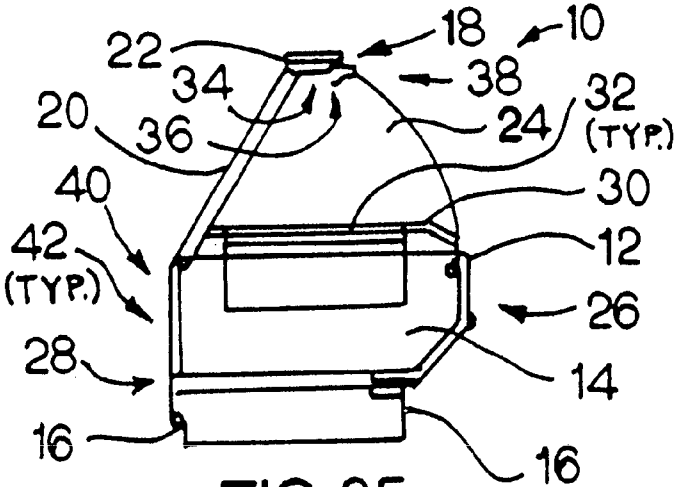

FIG.35

| | BMD 4-HOT | BMD 6-HOT | BMD 8-HOT |
|---|---|---|---|
| | Power Supply #1 | Power Supply #1 | Power Supply #1 |
| | Voltage: 208-1-60 | Voltage: 208-1-60 | Voltage: 208-1-60 |
| Lights | Wattage: 150 | Wattage: 150 | Wattage: 150 |
| Number of Lights | 2 | 3 | 4 |
| Total Amperes | 1.5 | 2.18 | 2.86 |

OBSERVED PERFORMANCE MAY VARY

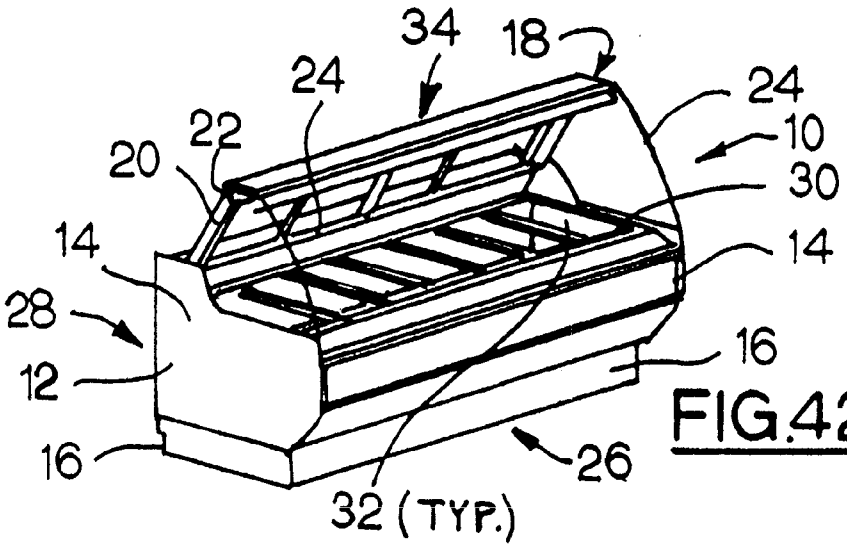

FIG.42

| | BSD 4-HOT | BSD 6-HOT | BSD 8-HOT |
|---|---|---|---|
| | Power Supply #2 | Power Supply #2 | Power Supply #2 |
| Designed Operating Temp. | 150-170F | 150-170F | 150-170F |
| | Voltage: 208-3-60 | Voltage: 208-3-60 | Voltage: 208-3-60 |
| Well Heaters | Wattage: 811 | Wattage: 811 | Wattage: 811 |
| Number of Well Heaters | 3 | 5 | 7 |
| Top Heaters | Wattage: 262 | Wattage: 262 | Wattage: 262 |
| Number of Heaters | 2 | 2 | 2 |
| Total Amperes | 10.25 | 15.8 | 22.01 |

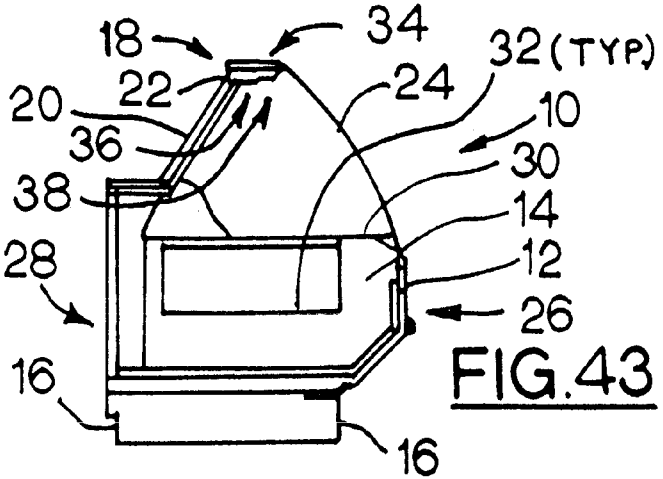

FIG.43

| | BSD 4-HOT | BSD 6-HOT | BSD 8-HOT |
|---|---|---|---|
| | Power Supply #1 | Power Supply #1 | Power Supply #1 |
| | Voltage: 208-1-60 | Voltage: 208-1-60 | Voltage: 208-1-60 |
| Lights | Wattage: 150 | Wattage: 150 | Wattage: 150 |
| Number of Lights | 2 | 3 | 4 |
| Total Amperes | 1.5 | 2.18 | 2.88 |

OBSERVED PERFORMANCE MAY VARY 16
10
12
16
52
48
14

10
48

16
12
16
52
48
14
10

48
10

16
14
52
48
12

48

FOOD MERCHANDISER AND TEMPERATURE CONTROL SYSTEM

This is a continuation of application Ser. No. 09/633,405 filed Aug. 7, 2000, now abn.

BACKGROUND OF THE INVENTION

The present invention relates in general to food merchandising equipment and pertains, more particularly, to food merchandisers of the type used in grocery stores, convenience stores and any other stores in which food may be offered for purchase or consumption. The food merchandiser of this invention is an improvement over the conventional merchandiser used to offer hot food for consumption or purchase.

With the conventional food merchandiser it is generally necessary to provide a heat source based upon steam, hot water or conventional electrical heating elements. Conventional heating elements include Cal-Rod-type elements used in numerous commercial and industrial applications and the heat energy supplied by these elements is sometimes referred to as short wave energy.

These conventional heat sources are constructed in a way that maintenance and clean-up of the steam and hot water sources are difficult and can accelerate deterioration of the components of the merchandiser. Another drawback associated with the conventional electrical heating elements is the creation of hot spots that ruin food displayed in the merchandiser due to hot spots created by the electrical heating elements.

Some conventional hot food merchandisers use electrical heating technology in which circular cross-section heating element rods loop underneath a well. A rod or combination of rods are controlled by a rheostat that lowers rod temperature by reducing voltage by means of a variable resistor which changes the current through the rods.

The heat energy generated by conventional electrical heat elements is intense and doesn't disperse evenly through the material on which the food rests. The heat generated by the conventional electrical heat sources tends to concentrate in spots on the heat-conducting tiles or sheets on which the food or food containers rest and the lack of heat dispersion creates an undesirable, uneven heat distribution that can result in continued cooking and burning of the product directly over one or more heating rods.

Thus, localized areas of intense heat and temperature can result in food spoilage and wasted electrical energy. Local hot spots are not desired for food display or storage and a rod or rods use excess energy to maintain the edges of the well at the minimum temperature while the portion of the well at and close to the location of the rod is overheated.

Another drawback associated with the aforementioned electrical heating elements is the use of conventional rheostats and associated circuitry to control the energy output of these electrical heating elements. Prior to this invention, the combination of these conventional controls and their equivalents has not provided a desired heat supply and or desired dispersion of the heat, resulting in a hot food merchandiser or other form of display apparatus that may tend to continue to cook the food therein rather than merely keep it warm.

The present invention includes the unique combination of a proportional controller to maintain an even output from a long wave energy heat source. Conventional proportional controllers also have drawbacks associated with their inability to satisfactorily handle noise typically found on a primary power line with the use of conventional filters, grounding configurations, or circuits to chop or otherwise modify primary line noise. In addition, conventional proportional controllers do not always reduce voltage in a satisfactory or adequate fashion.

SUMMARY OF THE INVENTION

Accordingly, it is an object of this invention to provide an improved merchandising or display case that is adapted to maintain food within a predetermined temperature range. With the merchandiser, heat source and controller of this invention heat distribution is more even and power consumption is reduced when compared to conventional equipment constructed for the same purpose.

Another object of this invention is to provide an improved hot food display case or merchandiser apparatus constructed to provide more uniform heat distribution to thus provide more uniform heating of food within case or apparatus.

A further object of this invention is to provide a hot food display case or merchandiser apparatus that is adapted for the uniformed, controlled heating of any food placed on a heat source within the case or apparatus to thereby substantially reduce any over-cooking of the food placed on the heat source.

Still another object of this invention is to provide a hot food display case or merchandiser apparatus that may provide heat from both above and below food placed within the case of apparatus. The case or apparatus of this invention may have an upper heat source comprised of a material providing a long wave energy heat source.

Still a further object of this invention is to provide an improved case or apparatus that is adapted for uniform operation of the heat source and the heat source controller. The case or apparatus of this invention is characterized by a improved uniformity in the source of heat and control of the heat output from the heat source.

Another object of this invention is to provide an improved hot food display case or merchandiser apparatus that includes a controller incorporating primary line noise control and suitable voltage reduction without an unnecessary feedback loop.

A further object of this invention is to provide an improved hot food display case or merchandiser apparatus that incorporates design flexibility as to heat source location, control and case or apparatus configuration and appearance. The construction of this invention allows for a variety of heat source locations and associated controls, that is, the number of hot "wells" may be selected to suit the application (e.g., grocery store, delicatessen, convenience food store), as illustrated in the accompanying drawing figures.

Still another object of this invention is to provide solid state percentage controller in combination with a poured heat element. This combination uses less energy as the entire heat element incorporated in this invention is alternately energized and de-energized and maintains a uniform temperature without the hot spots that can be created with conventional heating rod technology.

To accomplish the foregoing and other objects of this invention there is provided a hot food display case or merchandiser apparatus, hereinafter "display case" for controlling and maintaining food temperature within a preselected temperature range.

The display case comprises a case with side members or panels, toe kicks, typically front and back, and an upper support structure that provides support for one or more sliding doors, lights, and an upper heating element. The case includes a well or wells that receive a lower heating element material. A percentage controller described elsewhere in this application controls the temperature of the wells.

The display case of this invention is preferably adapted for use as a heated or hot food display case. The drawing figures contained herein illustrate the ornamental design of preferred embodiments of this invention.

While this invention is particularly adapted for use with heated display cases, it will be understood that the display cases of this invention may also include conventional refrigeration apparatus and the drawing figures reflect embodiments of this invention incorporating the refrigeration equipment.

In the disclosed embodiments described herein, there are provided display cases with three or more heated wells and an upper heating element are incorporated into this invention.

There is also provided a percentage controller that comprises one ore more controllers for each display case. The description of the percentage controller invention includes one or more percentage controller power panel switches and a preferred embodiment of the percentage controller schematic from which one skilled in the art will readily understand this invention.

In this disclosed embodiment described herein, there are provided a controller for each heated well and upper heated element for the display cases described and shown herein. It will thereafter be understood that the percentage controller of this invention is readily adapted to other AC voltage control applications, and is not limited to use with the display case embodiment described, shown and claimed.

These and other objects and features of this invention will be better understood and appreciated from the following detailed description of preferred embodiments thereof, selected for purposes of illustration and shown in the accompanying drawings.

BRIEF DESCRIPTION OF THE DRAWINGS

FIG. 1 is a front isometric view of a preferred embodiment of a display case constructed in accordance with this invention;

FIG. 2 is a rear isometric view of the preferred embodiment of the display case illustrated in FIG. 1;

FIG. 3 is a rear view of the preferred embodiment of the display case illustrated in FIG. 1;

FIG. 4 is an end view of the preferred embodiment of the display case illustrated in FIG. 1 in which the opposite side view is a mirror image;

FIG. 5 is a bottom view of the preferred embodiment of the display case illustrated in FIG. 1;

FIG. 7 is a front isometric view of another preferred embodiment of a display case constructed in accordance with this invention;

FIG. 8 is a rear isometric view of the preferred embodiment of the display case illustrated in FIG. 7;

FIG. 9 is a rear view of the preferred embodiment of the display case illustrated in FIG. 7;

FIG. 10 is an end view of the preferred embodiment of the display case illustrated in FIG. 7 in which the opposite side view is a mirror image;

FIG. 11 is a bottom view of the preferred embodiment of the display case illustrated in FIG. 7;

FIG. 13 is a front isometric view of another preferred embodiment of a display case constructed in accordance with this invention;

FIG. 14 is a rear isometric view of the preferred embodiment of the display case illustrated in FIG. 13;

FIG. 15 is a rear view of the preferred embodiment of the display case illustrated in FIG. 13;

FIG. 16 is an end view of the preferred embodiment of the display case illustrated in FIG. 13 in which the opposite side view is a mirror image;

FIG. 17 is a bottom view of the preferred embodiment of the display case illustrated in FIG. 13;

FIG. 19 is a front isometric view of another preferred embodiment of a display case constructed in accordance with this invention;

FIG. 20 is a rear isometric view of the preferred embodiment of the display case illustrated in FIG. 19;

FIG. 21 is a rear isometric view of the preferred embodiment of the display case illustrated in FIG. 19;

FIG. 22 is an end view of the preferred embodiment of the display case illustrated in FIG. 19 in which the opposite side view is a mirror image;

FIG. 23 is a bottom view of the preferred embodiment of the display case illustrated in FIG. 19;

FIG. 26 is a front isometric view of another preferred embodiment of a display case constructed in accordance with this invention;

FIG. 27 is an end view of the preferred embodiment of the display case illustrated in FIG. 26 partially cut away to show the interior construction of the display case in which the opposite exterior side view is a mirror image;

FIG. 28 is a bottom view of the preferred embodiment of the display case illustrated in FIGS. 26 and 27 depicting a three (3) well embodiment;

FIG. 29 is a bottom view of the preferred embodiment of the display case illustrated in FIGS. 26 and 27 depicting a four (4) well embodiment;

FIG. 30 is a bottom view of the preferred embodiment of the display case illustrated in FIGS. 26 and 27 depicting a five (5) well embodiment;

FIG. 31 is a bottom view of the preferred embodiment of the display case illustrated in FIGS. 26 and 27 depicting a seven (7) well embodiment;

FIG. 32 is a bottom view of the preferred embodiment of the display case illustrated in FIGS. 26 and 27 depicting a nine (9) well embodiment;

FIG. 33 is a bottom view of the preferred embodiment of the display case illustrated in FIGS. 26 and 27 depicting an eleven (11) well embodiment;

FIGS. 34 through 41 illustrate another ornamental design of another preferred embodiment of this invention except for a direct top view and a direct rear view which will be understood by one of skill in the art once this application is read and understood, particularly since the rear view with the control panels is the essentially same as the rear views illustrated in other drawing figures herein except for the variation in length as the number of wells varies among embodiments;

FIG. 34 is a front isometric view of another preferred embodiment of a display case constructed in accordance with this invention;

FIG. 35 is an end view of the preferred embodiment of the display case illustrated in FIG. 34 partially cut away to show the interior construction of the display case in which the opposite exterior side view is a mirror image;

FIG. 36 is a bottom view of the wells of the preferred embodiment of the display case illustrated in illustrated in FIGS. 34 and 35 depicting a three (3) well embodiment;

FIG. 37 is a bottom view of the preferred embodiment of the display case illustrated in FIGS. 34 and 35 depicting a three (3) well embodiment;

FIG. 38 is a bottom view of the wells of the preferred embodiment of the display case illustrated in illustrated in FIGS. 34 and 35 depicting a five (5) well embodiment;

FIG. 39 is a bottom view of the preferred embodiment of the display case illustrated in FIGS. 34 and 35 depicting a five (5) well embodiment;

FIG. 40 is a bottom view of the wells of the preferred embodiment of the display case illustrated in illustrated in FIGS. 34 and 35 depicting a seven (7) well embodiment;

FIG. 41 is a bottom view of the preferred embodiment of the display case illustrated in FIGS. 34 and 35 depicting a five (5) well embodiment;

FIGS. 42 through 49 illustrate another ornamental design of another preferred embodiment of this invention except for a direct top view and a direct rear view which will be understood by one of skill in the art once this application is read and understood, particularly since the rear view with the control panels is the essentially same as the rear views illustrated in other drawing figures herein except for the variation in length as the number of wells varies among embodiments;

FIG. 42 is a front isometric view of another preferred embodiment of a display case constructed in accordance with this invention;

FIG. 43 is an end view of the preferred embodiment of the display case illustrated in FIG. 42 partially cut away to show the interior construction of the display case in which the opposite exterior side view is a mirror image;

FIG. 44 is a bottom view of the wells of the preferred embodiment of the display case illustrated in illustrated in FIGS. 42 and 43 depicting a three (3) well embodiment;

FIG. 45 is a bottom view of the preferred embodiment of the display case illustrated in FIGS. 42 and 43 depicting a three (3) well embodiment;

FIG. 46 is a bottom view of the wells of the preferred embodiment of the display case illustrated in illustrated in FIGS. 42 and 43 depicting a five (5) well embodiment;

FIG. 47 is a bottom view of the preferred embodiment of the display case illustrated in FIGS. 42 and 43 depicting a five (5) well embodiment;

FIG. 48 is a bottom view of the wells of the preferred embodiment of the display case illustrated in illustrated in FIGS. 42 and 43 depicting a seven (7) well embodiment;

FIG. 49 is a bottom view of the preferred embodiment of the display case illustrated in FIGS. 42 and 43 depicting a seven (7) well embodiment;

FIG. 50 is a front isometric view of another preferred embodiment of a display case constructed in accordance with this invention;

FIG. 51 is a rear view of the preferred embodiment of the display case illustrated in FIG. 50 partially cut away to show the interior construction of the display case;

FIG. 52 is an end view of the preferred embodiment of the display case illustrated in FIG. 50 partially cut away to show the interior construction of the display case in which the opposite exterior side view is a mirror image;

FIG. 57 is a front isometric view of a preferred embodiment of a display case constructed in accordance with this invention;

FIG. 58 is an end view of the preferred embodiment of the display case illustrated in FIG. 57 partially cut away to show the interior construction of the display case in which the opposite exterior side view is a mirror image;

FIG. 59 is a bottom view of the preferred embodiment of the display case illustrated in FIGS. 57 and 58 depicting a three (3) well embodiment;

FIG. 60 is a bottom view of the preferred embodiment of the display case illustrated in FIGS. 57 and 58 depicting a five (5) well embodiment;

FIG. 61 is a bottom view of the preferred embodiment of the display case illustrated in FIGS. 57 and 58 depicting a seven (7) well embodiment.

DETAILED DESCRIPTION OF THE INVENTION

Display Case and Heating Element

Figure 1:
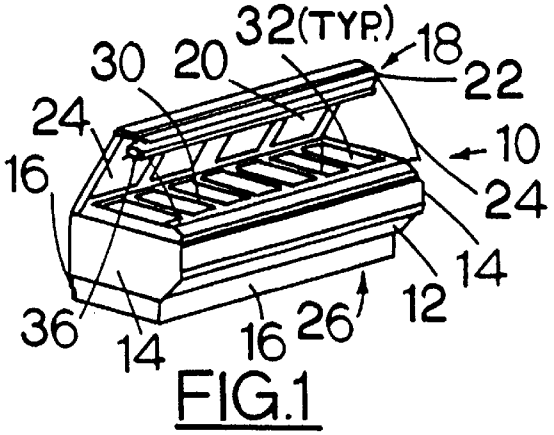
FIGS. 1 through 5 illustrate an ornamental design of a preferred embodiment of this invention except for a direct top view which will be understood by one of skill in the art once this application is read and understood.
Figure 2:
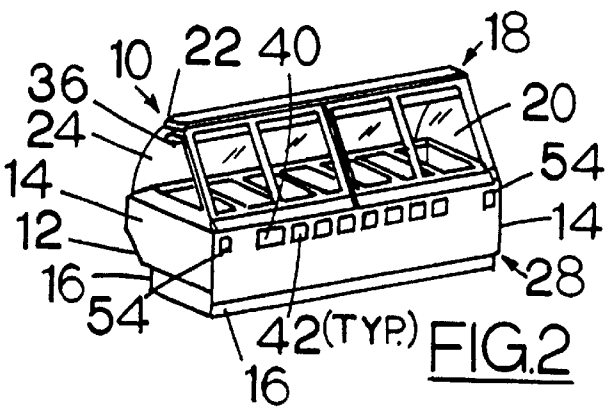
Figure 3:
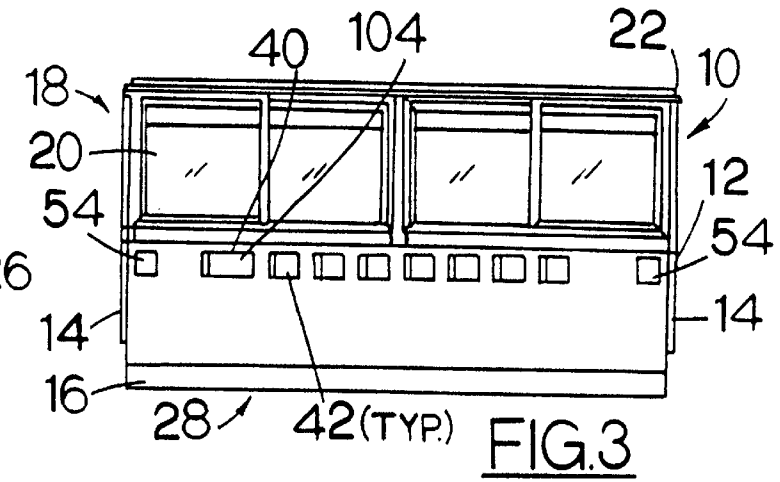
Figure 4:
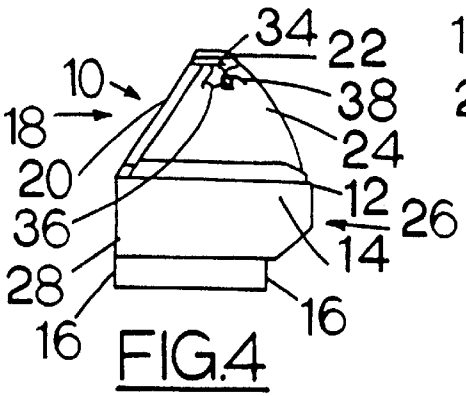
Figure 6:
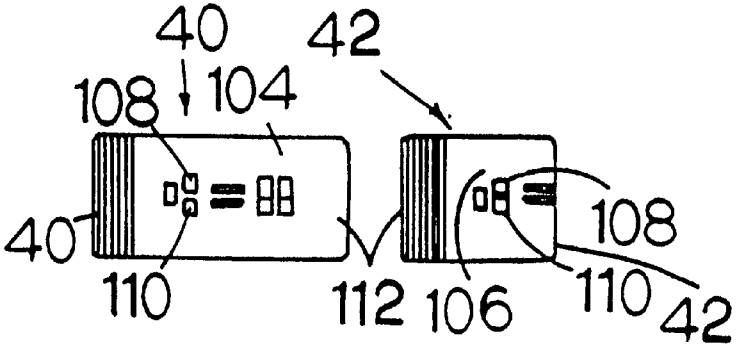
FIG. 6 is an illustration of a preferred embodiment of control panels for the display case illustrated in FIGS. 1 through 5.
Figure 8:
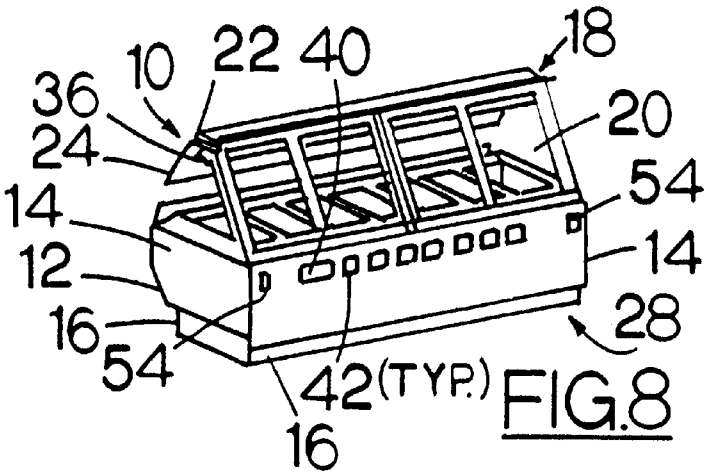
FIGS. 7 through 11 illustrate another ornamental design of another preferred embodiment of this invention except for a direct top view which will be understood by one of skill in the art once this application is read and understood.
Figure 5:
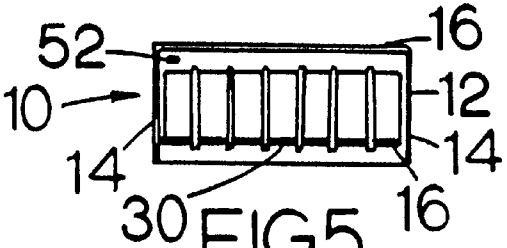
Figure 7:
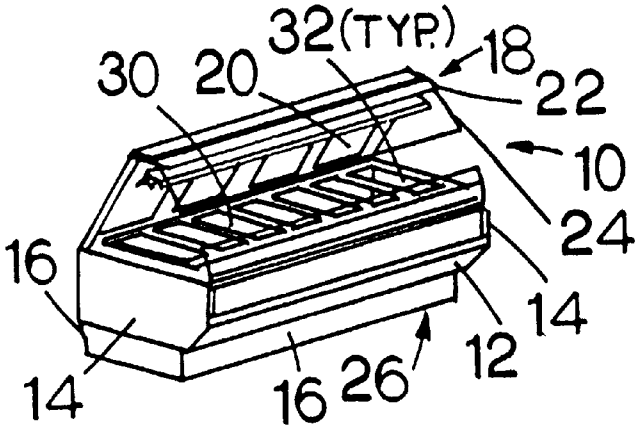
Figure 10:
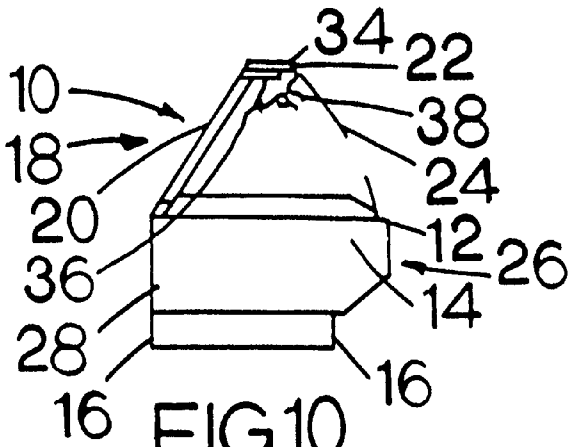
Figure 12:
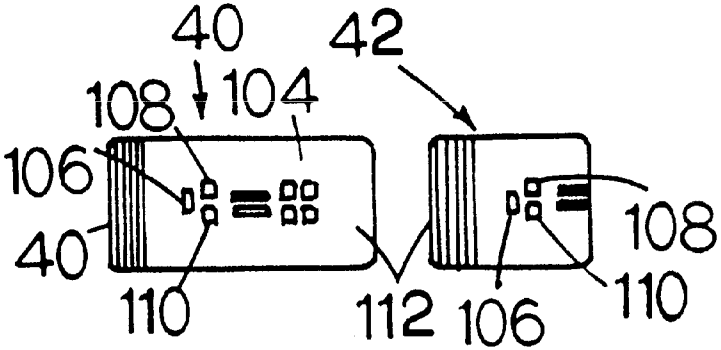
FIG. 12 is an illustration of a preferred embodiment of control panels for the display case illustrated in FIGS. 7 through 11.
Figure 9:
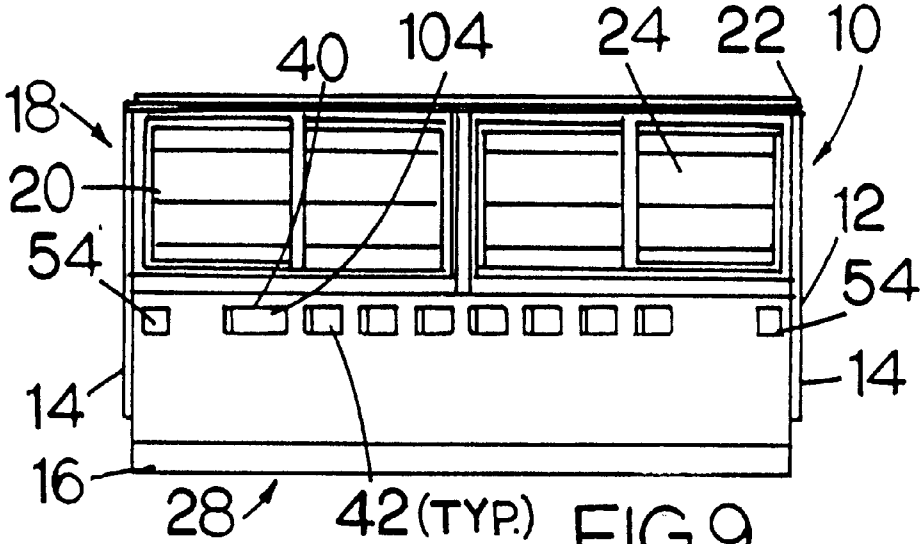
Figure 11:
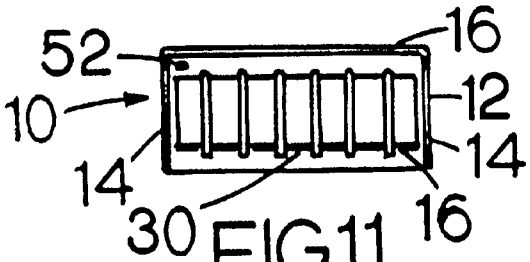
Figure 14:
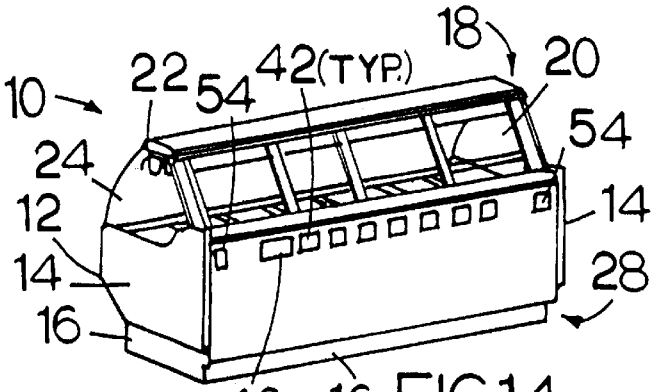
FIGS. 13 through 17 illustrate another ornamental design of another preferred embodiment of this invention except for a direct top view which will be understood by one of skill in the art once this application is read and understood.
Figure 15:
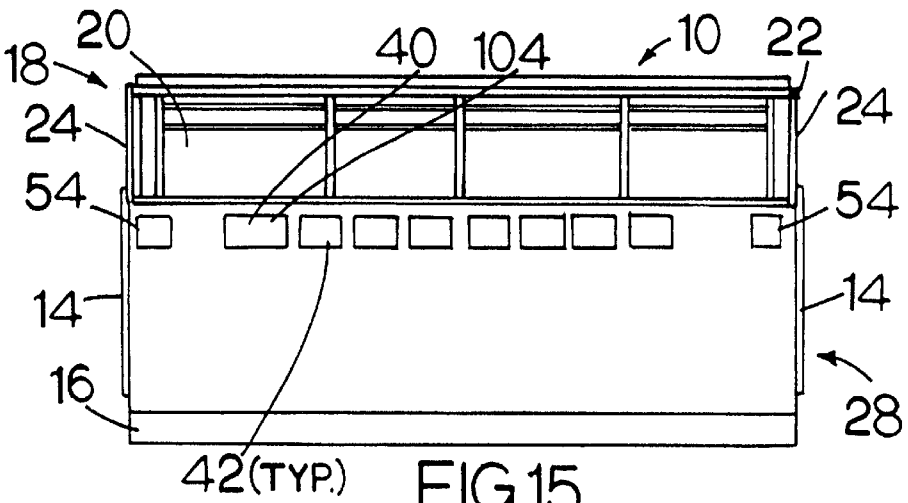
Figure 13:
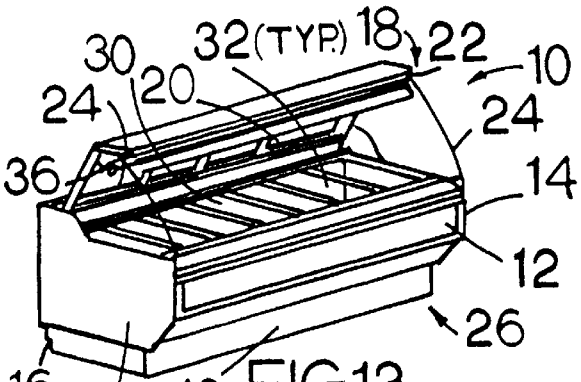
Figure 16:
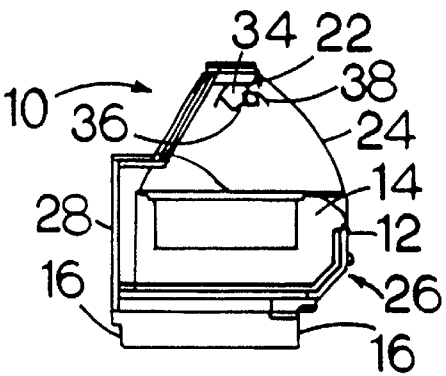
Figure 18:
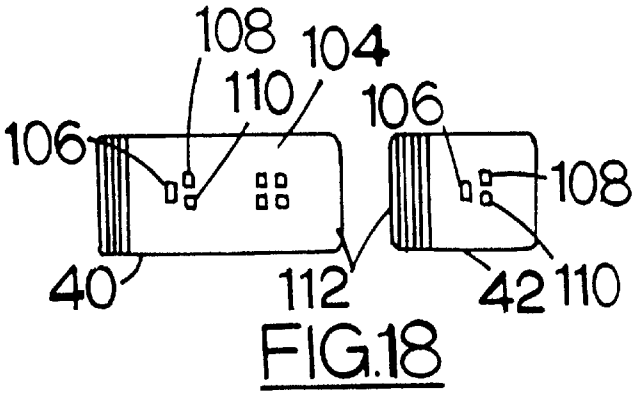
FIG. 18 is an illustration of a preferred embodiment of control panels for the display case illustrated in FIGS. 13 through 17.
Figure 17:
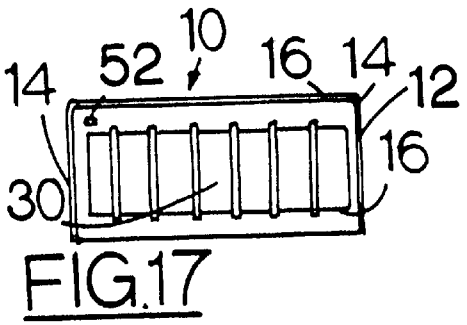
Figure 20:
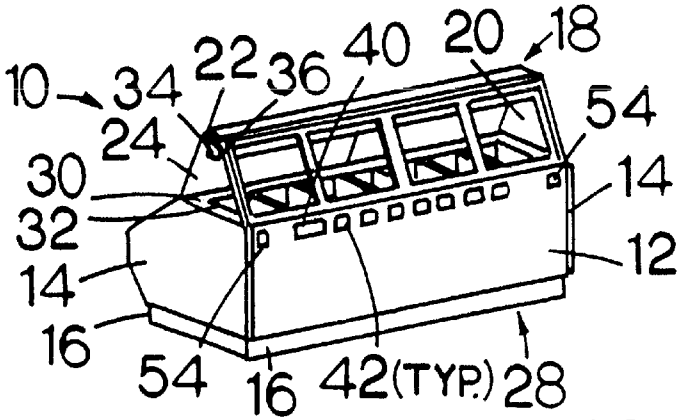
FIGS. 19 through 23 illustrate another ornamental design of another preferred embodiment of this invention except for a direct top view which will be understood by one of skill in the art once this application is read and understood.
Figure 19:
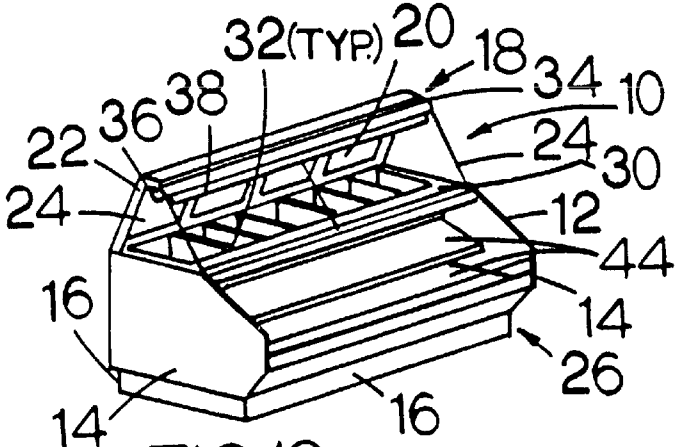
Figure 21:
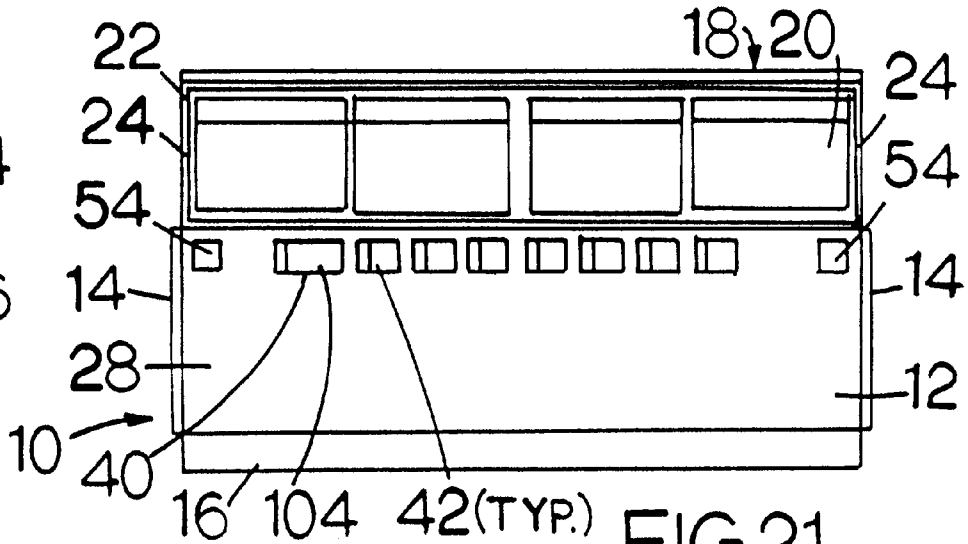
Figure 22:
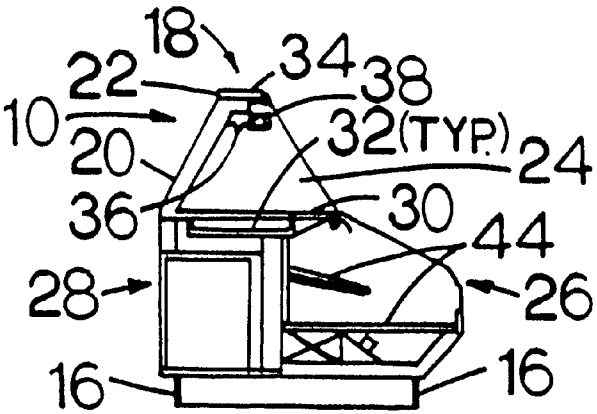
Figure 24:
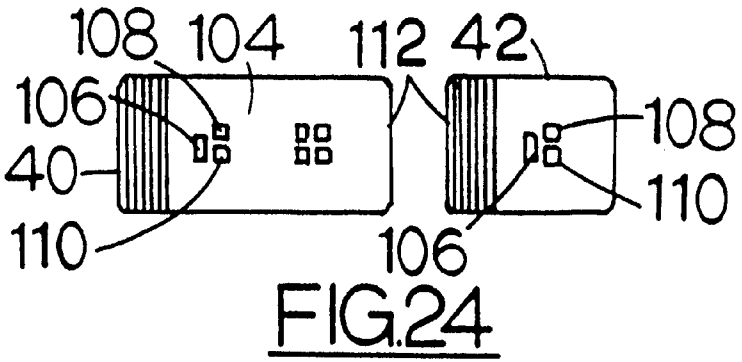
FIG. 24 is an illustration of a preferred embodiment of control panels for the display case illustrated in FIGS. 19 through 23.
Figure 23:
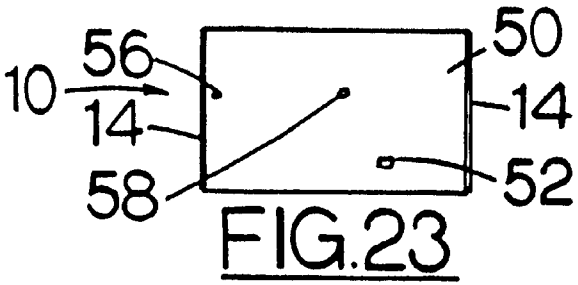
Figure 25:
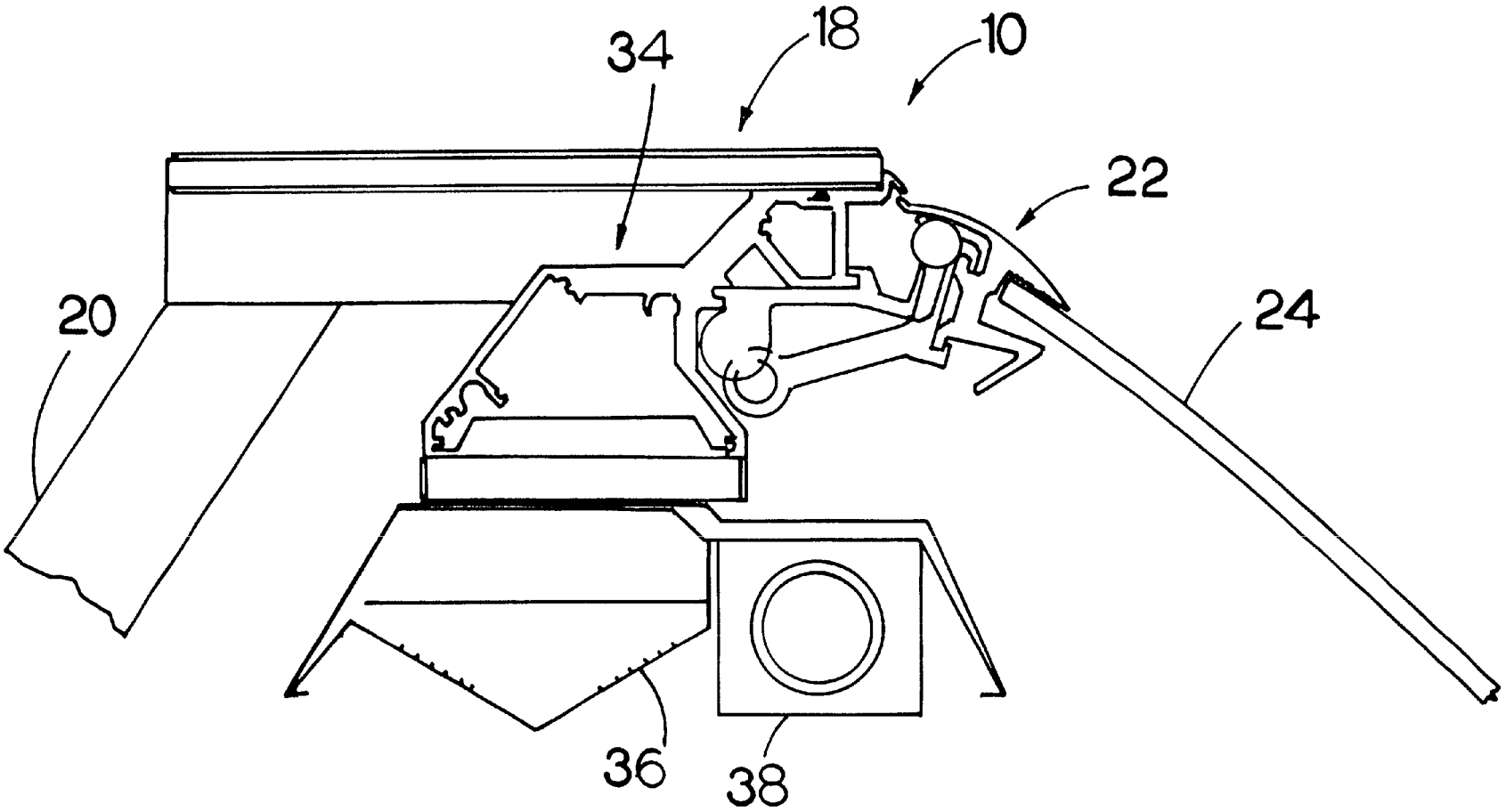
FIG. 25 is a cross-sectional view taken through the top portion of the display cases illustrated and described herein, illustrating a preferred embodiment of an upper heating element and an upper light source, this cross-sectional view representing the upper heating element and light configuration for each of the display cases illustrated herein.
Figure 27:
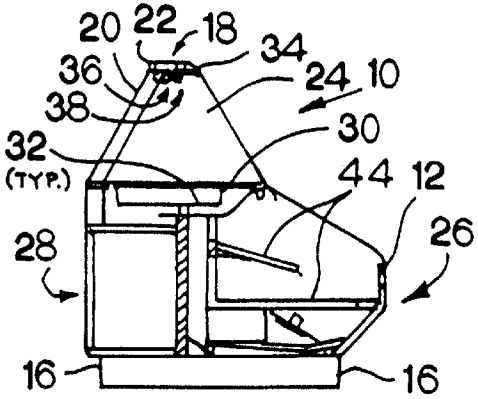
FIGS. 26 through 33 illustrate another ornamental design of another preferred embodiment of this invention except for a direct top view and a direct rear view which will be understood by one of skill in the art once this application is read and understood, particularly since the rear view with the control panels is essentially the same as the rear views illustrated in other drawing figures herein except for the variation in length as the number of wells varies among embodiments.
Figure 26:
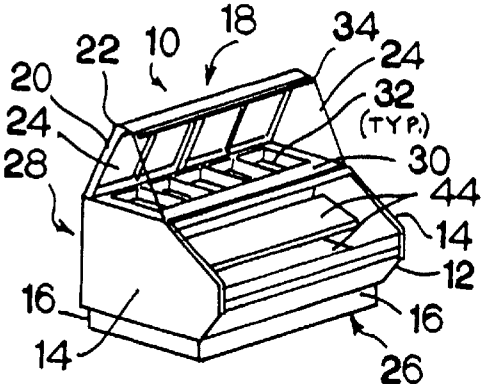
Figures 28, 29, 30, 31, 32, 33:
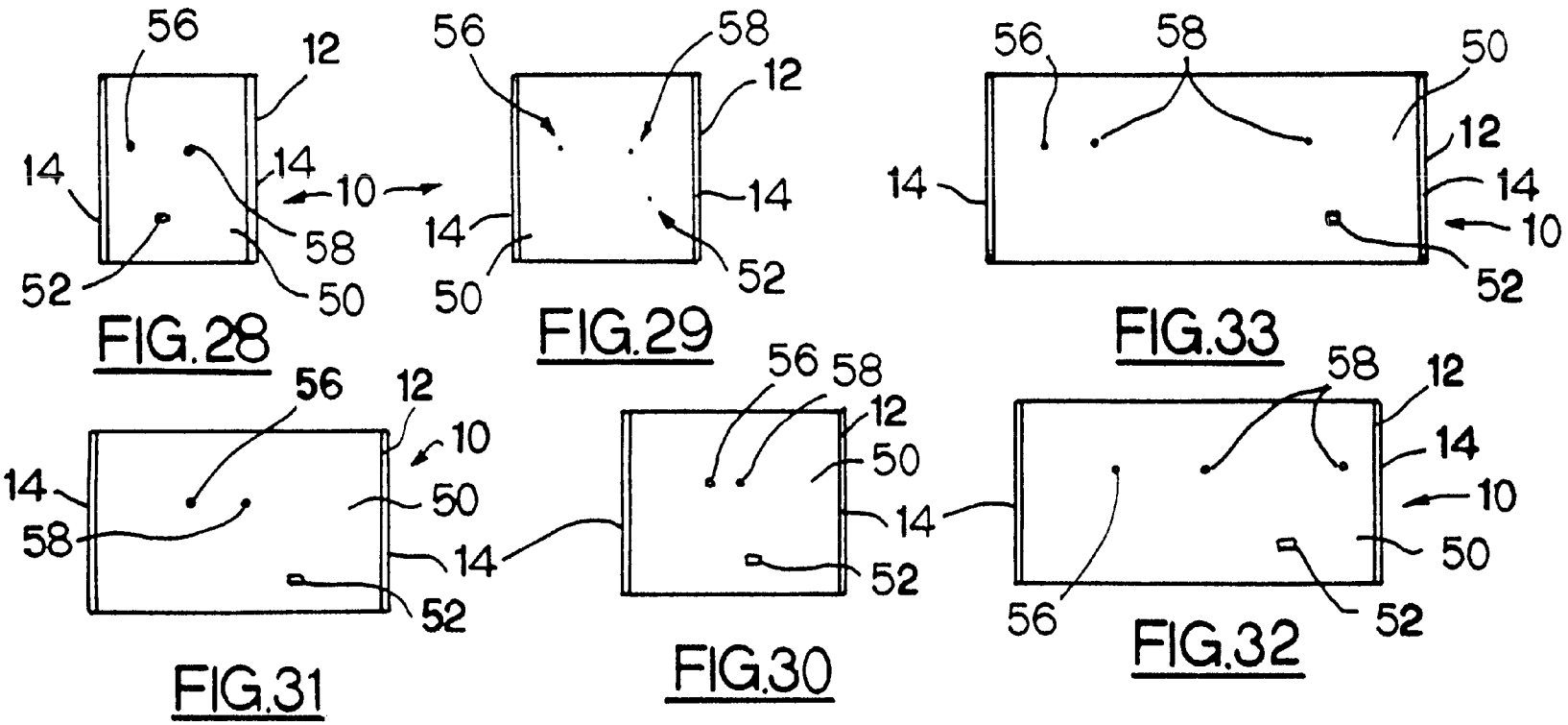
Figure 37:
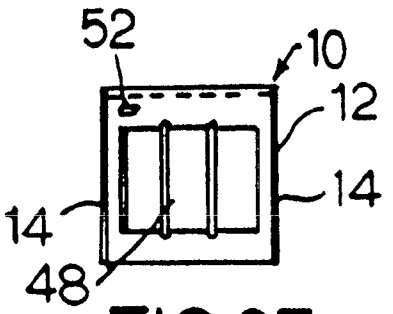
Figure 36:
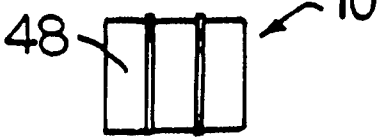
Figure 39:
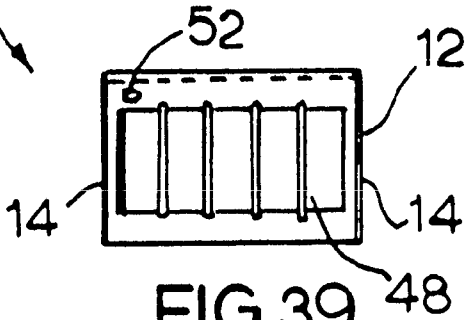
Figure 38:
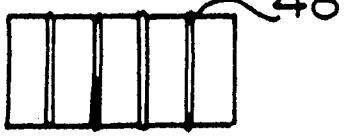
Figure 41:
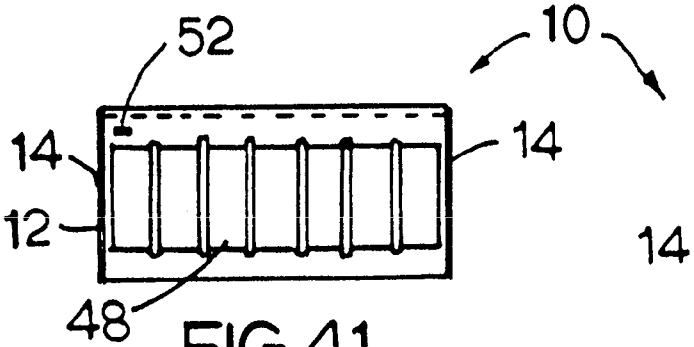
Figure 40:
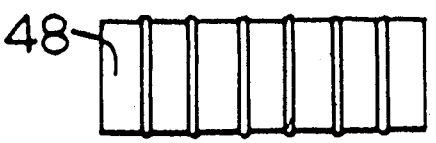
Figures 44, 45, 46, 47, 48, 49:
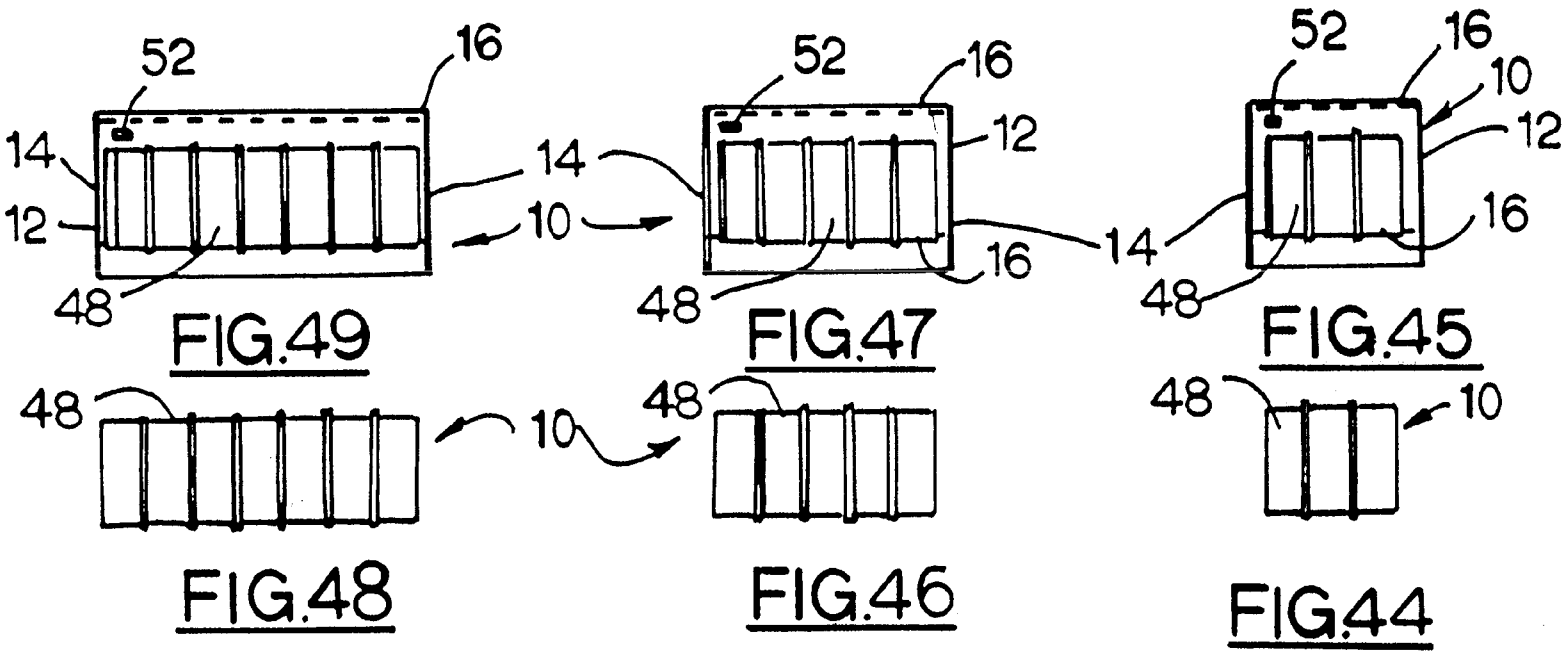

Referring now to the drawings there are shown preferred embodiments for the display case and controller of this invention and, more particularly, in this portion of the Detailed Description there is described a display case. The display case is described in connection with a hot food merchandiser suitable for use in grocery stores to display hot food, allow self service of hot food or a combination of display and self service of hot food.

The display case of this invention is particularly adapted for providing even temperature and uniform heating of the hot food in the display case. The display case is characterized by one or more lower, heated wells manufactured at least in part from a heating material or element on which the food is placed and an upper heating element manufactured from the same or equivalent material as the lower elements.

Various embodiments of preferred embodiments of this invention are illustrated in the drawing figures. The drawing figures also disclose the ornamental design for the display cases (the ornamental designs are fully disclosed in view of the fact that any view not directly shown can be either directly understood from the drawing figures or it is understood that the view not directly shown is a substantially flat panel).

The drawings show the display case 10 (like elements of the preferred embodiments illustrated and described herein are identified with like reference characters) in conjunction with a display case for hot food, with or without a refrigeration or cooling unit, that comprises a case 12 that usually has side members or panels 14 at each end of the display case. An upper support structure 18 supports one or more sliding doors 20 and the upper support structure includes a door slide and support structure. In the preferred embodiments of the display cases shown and describe, various display cases also include upper member 24.

Each display case 10 also includes a front panel 26 and a rear panel 28. The food is typically displayed on a well support member 30 forming one or more wells with each well to be heated having well heating element member 32.

An upper heating element and light support member 34 supports an upper heating element 36 and a display case light 38. Operation of each well heating element 32 and upper heating element 36 are controlled from control panels 40, 42, as will be better understood upon reference to the operation of this invention and the Barker Company operating manuals attached hereto and incorporated herein by reference.

The heating element 32 and upper heating element 36 are preferably cast infrared emitter panels of the type manufactured by Black Body Corporation, St. Louis, Mo. and provided with thermal dividers were necessary. The disclosure of U.S. Pat. Nos. 3,809,859 and 4,017,967 is incorporated herein by reference in order to further disclose the method of manufacture of the preferred embodiment of the heating element 32, 36 of this invention.

Heating element 36 is preferably poured in place within its respective well in display case 10. Upper heating element 36 is preferably cast in a suitable mold, removed from the mold and installed and supported from upper support structure 18 as illustrated herein or in an equivalent structure such that infrared emission from the upper heating element 36 is directed toward the food in the display case.

A V-shaped upper heating element 36 is illustrated in the drawing figures. The two surfaces of the upper heating element 36 form a 120° angle. Other shapes are possible and the upper heating element may form a convex shape or a concave shape as the application of the upper heating element in the display case warrants.

The attached wiring diagrams illustrate a preferred wiring of heating element 32 and upper heating element 36 in their respective display case. One skilled in the art will recognize that other wiring schemes are possible. A percentage control system of the type disclosed herein is wired into the display case in order to control the voltage which provides for temperature control of the food in the display case.

A variety of display cases 10 are illustrated and described herein. Some of the embodiments include conventional refrigeration equipment to cool a portion of the display case and further description of the refrigeration equipment is not required as its design and function will be readily understood by one skilled in the art.

The display cases 10 include preferred embodiments with self service shelves 44. These preferred embodiments can incorporate one or more self service shelf heating elements 46. Similarly, it will be observed that the design of display cases 10 is sufficiently flexible so as to allow either a bottom member 48 with one or more wells or a bottom member 50 without a well.

Suggested locations for a display case power supply 52, ventilation grilles 54, refrigeration lines 56 for cooled embodiments of this invention and a drain 58 are illustrated in the drawing figures.

In operation, in connection with the percentage controller system described below, to control the temperature of the heating elements in the display case, digital controls incorporated into control panels 40, 42, are typically grouped in clusters. In a preferred embodiment, each display case will have controls incorporated into control panel 40 and one or more controls incorporated into control panel 42.

Control panel 42 provides for turning the display case power on and off, turning the lights on and off and controlling the upper heating element. At least one control panel 42 will be associated with each display case 10 for well temperature control. As illustrated on page 9 of the attached Service and Installation Instructions, a combination service and self service display case will have controls for the upper heating element.

Prior to operation, it is recommended that the display case heating elements are pre-heated while the display case is empty. In one preferred embodiment, the display case is pre-heated for 120 minutes before being loaded with product preheated to approximately 160° F.

Each display case will have product load limits and suggested controller settings. These are described in more detail in the attached Service and Installation Instructions as are the suggested steps for cooling down and cleaning the display case.

Turning now to the operation of the display case heat element controller, the percentage control system incorporated into the display case of this invention now will be described.

Percentage Control System

Referring again to the drawings there is shown a preferred embodiment for the percentage control system of this invention. The percentage control system is described in connection with a food merchandiser or display case, hereinafter display case, to control the temperature of at least one heat element in at least one well or an overhead heat element or a combination of both.

The percentage control system of this invention is particularly adapted for providing an energy effective control system that has a quality of low noise generation and low stress on components, particularly the heating elements. This invention is characterized by an on/off percentage control based on a fixed timing interval, which timing is based on multiple line frequency with *close to* a zero crossing firing angle.

It will be understood by one skilled in the art that the percentage controller system of this invention is not limited to display cases. Understanding the application of the percentage controller in the display case example herein will provide sufficient understanding to apply the percentage controller to other applications in which an on/off percentage control based on a fixed timing interval, which timing is based on multiple line frequency with *close to* a zero crossing firing angle is applicable.

Figure 55A:
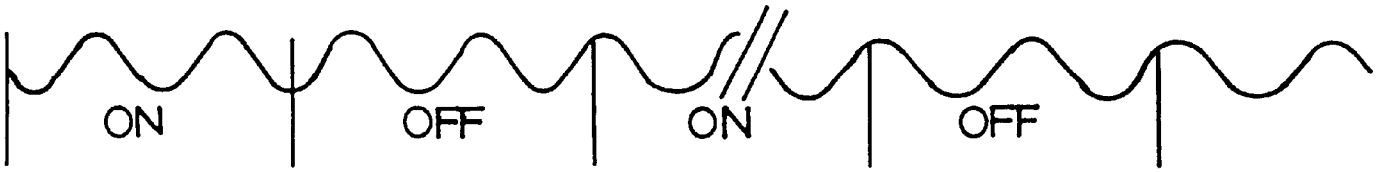
FIGS. 55(*a*) through 55(*c*) illustrate theoretical modes of controlling alternating current ("AC") power to an electrical heating element.
Figure 55B:
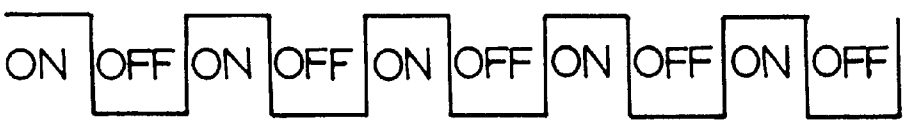
Figure 55C:
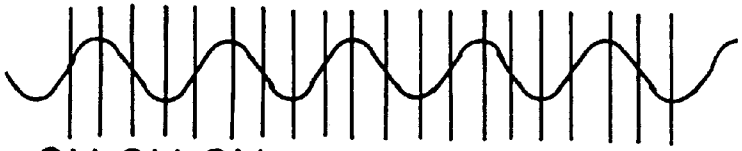

In order to further understand this invention, FIGS. 55(*a*) through 55(*c*) illustrate three (3) theoretical modes of controlling AC power to an electrical heating element. FIG. 55(*a*) depicts the operation of an on/off percentage control (a 50% duty cycle illustrated in the drawing figure) based on a fixed timing interval that does not detect an firing angle, thereby resulting in a random firing angle. FIG. 55(*b*) depicts the operation of an on/off percentage control (a 50% duty cycle illustrated in the drawing figure) based on direct voltage chopping in which AC voltage is first converted to direct ("DC") current voltage and then power is delivered to an output by conventional "chopper" circuitry. FIG. 55(*c*) depicts the operation of an on/off percentage control (a 50% duty cycle illustrated in the drawing figure) based on firing a fixed angle at every incoming power cycle and zero crossing detection firing 90° and 270°.

Figure 56:
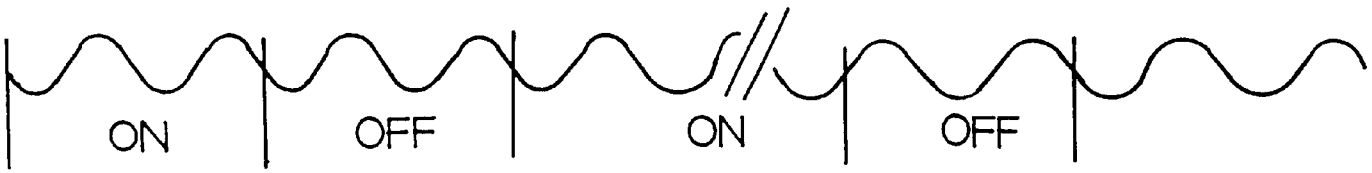
FIG. 56 illustrate the theoretical mode of controlling AC power to an electrical heating element utilized by this invention as depicted in the preferred embodiment shown in FIGS. 53 and 54.
Figure 58:
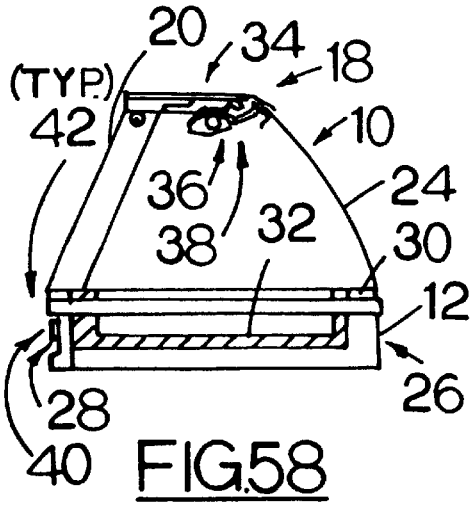
FIGS. 57 through 61 illustrate an ornamental design of a preferred embodiment of this invention except for a direct top view and direct rear view which will be understood by one of skill in the art once this application is read and understood.
Figure 57:
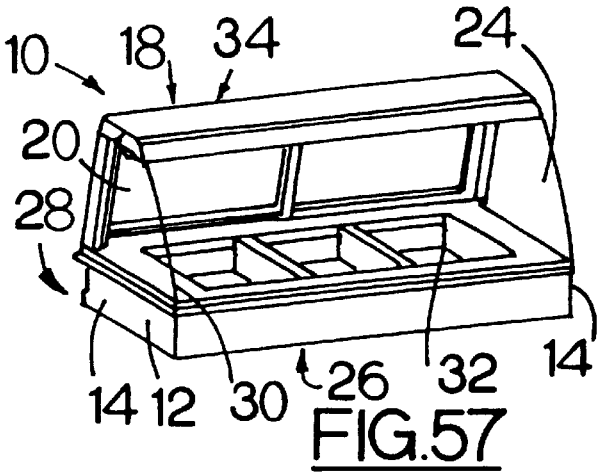
Figure 59:
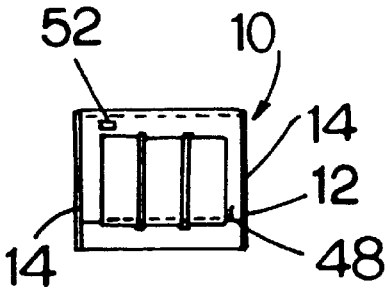
Figure 60:
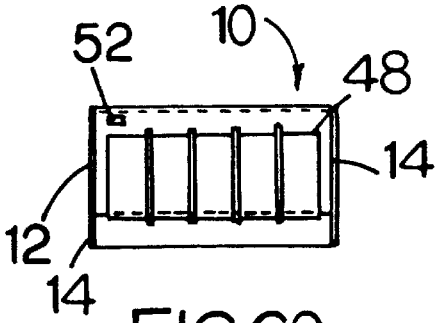
Figure 61:
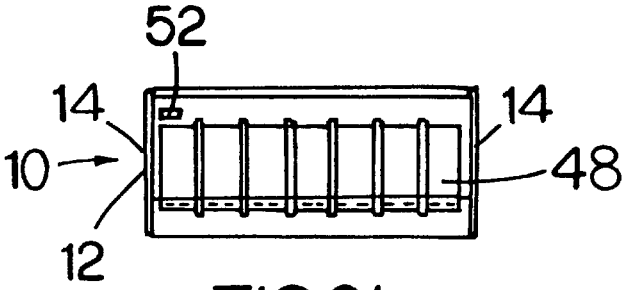

A preferred embodiment of this invention is illustrated in FIG. 56 with a 50 % duty cycle and zero crossing detection. This is an exemplary operation cycle for the percentage control system of this invention which provides an effective and efficient use of energy while generating minimum noise and resulting in little stress on connected components due to the 100% voltage on and the 100% voltage off operating characteristics of the percentage control system.

The drawings show a percentage controller 100 in conjunction with a percentage controller power panel switches 102. Upon reading the following disclosure, one skilled in the art will recognize that the percentage controller 100 and the power panel switches 102 are described in conjunction with, but are not limited to, the display case example.

The percentage control system of this invention is applicable and provides the desired voltage control where full line current and voltage is controlled and noise on a primary line must be handled without conventional filtering, chopping, or modification.

In the display case embodiment illustrated and described herein, percentage controller 100 delivers a fixed-percentage output power to the heating element 32, 36 based on a programmed setting. The programmed setting is shown as "0" to "9" on a display of the control panels.

A zero setting is a standby mode, with no power applied to the heating element 32, 26. A "9" is the highest percentage output power.

A power panel front panel 104 includes four functions in one preferred embodiment provided in association with the display case 10. A seven-segment LED display 106 displays a current setting, an increment button 108 and a decrement button 110 provide for manual adjustment of the percentage controller setting, and an indication LED 112 shows that power is being applied to the heating element 32, 36.

A detailed description of one preferred embodiment of the circuitry of the percentage controller of this invention and the operation, in general, of the percentage controller of this invention are both set forth below.

A logic operation voltage supply 114 is provided as 5V DC for logic operation in the illustrated preferred embodiment and is obtained from a power supply 116 which is obtained directly from 220V AC in the illustrated embodiment by components including a capacitor 118 (C1), a capacitor 120 (C3), rectifiers 122, 124 (D1, D3), zener diode 126 (D2) and a resistor 128 (R2).

A cycle counter 130 (U1) counts every incoming cycle from the power line. The incoming cycles are counted up by one and this count is also registered into the processor 132 (U4) via pin 134 (TOCKI pin).

When the counter 130 (U1) reaches the count of 32, this signal is routed to a reset pin of processor 132 (U4), thereby resetting the processor. After a slight delay, the cycle counter 130 (U1) is reset and starts counting from zero again. This 32-cycle period is considered as one full heating cycle.

The use of a resistor 136 (R9) and a capacitor 138 (C5) create a long enough reset pulse to make sure that both processor 132 (U4) and cycle counter 130 (U1) are reset properly.

After the processor 132 comes out of the reset stage, it will start the "on" portion of the full heating cycle by turning on the power to the output terminals 140, which include in the preferred embodiment illustrated herein a resistor 142 (R18), another resistor 144 (R24), a capacitor 146 (C7), a transistor 148 (TR1), another resistor 150 (R20) and another capacitor 152 (C8).

The processor 132 (U4) reads the setting value from an EEPROM 154 (U5). The EEPROM design may vary, for example, one version of the chip in another preferred embodiment of this invention has the EEPROM 154 built into the processor so that the setting can be read from inside the chip. The setting is converted into internal value and the corresponding mapped number is shown on the LED display 112.

In accordance with this invention, every incoming cycle will cause the processor 132 (U4) internal counter to count up one count. The processor 132 constantly compares this value with the internal setting value, if they match, then the power output circuitry is turned off, thereby ending the "on" portion and starting the "off" portion of one full heating cycle.

The processor 132 also monitors the two push buttons 156, 158 (SW1 and SW2). If any of the buttons are being pushed, the setting will increment/decrement by one count unless it has reached the top or the bottom of the range. This new setting is written into the EEPROM.

A data latch 160 (U3) has an output that drives the LED display and the power output stage. The latched data is strobed into this chip by the processor and will not change during the processor resetting time. In effect, even though the processor is being reset almost every half second, the display and power output are stable and have no flickering effect.

It will now be understood that by resetting the processor constantly, the processor is guaranteed to start out fresh and at a known stage after every reset. Any problems that are caused by electrical noise interference such as processor lockup, self-looping would be self-correcting after one full heating cycle. No operator intervention or manual reset is needed. The constant resetting method of this invention assures a pre-settable stable power level delivered to the heating element or other AC voltage responsive component in the most reliable way.

The operation of the display case and the percentage controller of this invention will now be understood, generally for the percentage controller of this invention to control an AC output voltage, as well as specifically in connection with the display case application previously described above to efficiently control the output of one or more electric heating elements.

In preferred embodiments, the display cases operate and appear as illustrated in the drawing figures and described herein. Operation of the percentage controller of this invention will now be understood for the display cases shown and described and for other suitable applications, as well.

In preferred embodiments of the display case the light 38 is a quartz light, the display case dimensions are as shown on the drawings, and representative display case operation temperatures, operating voltage, and well placements and arrangements are also shown and described.

While specific embodiments have been shown and described, many variations are possible. The particular shape and arrangement of the display case may be changed as desired to suit the installation requirements and food merchandising requirements. The heating element shapes and sizes may vary as required for particular applications with appropriate re-calibration of the temperature control system, as needed. Other embodiments of the display case may have a combination of upper heat elements and well heat elements not shown or described. The percentage controller application may vary and is not limited to display cases of the type shown and described herein, or display cases at all, for that matter.

Figure 51:
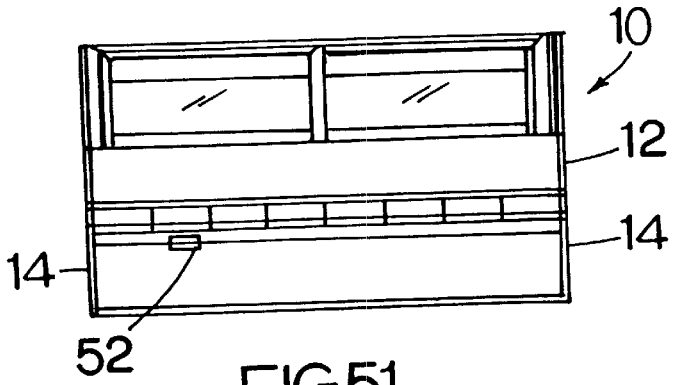
FIGS. 50 through 52 illustrate another ornamental design of another preferred embodiment of this invention except for a direct top view and a direct bottom view which will be understood by one of skill in the art once this application is read and understood.
Figure 52:
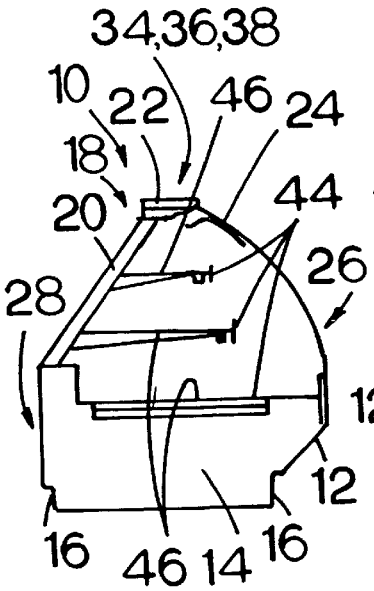
Figure 50:
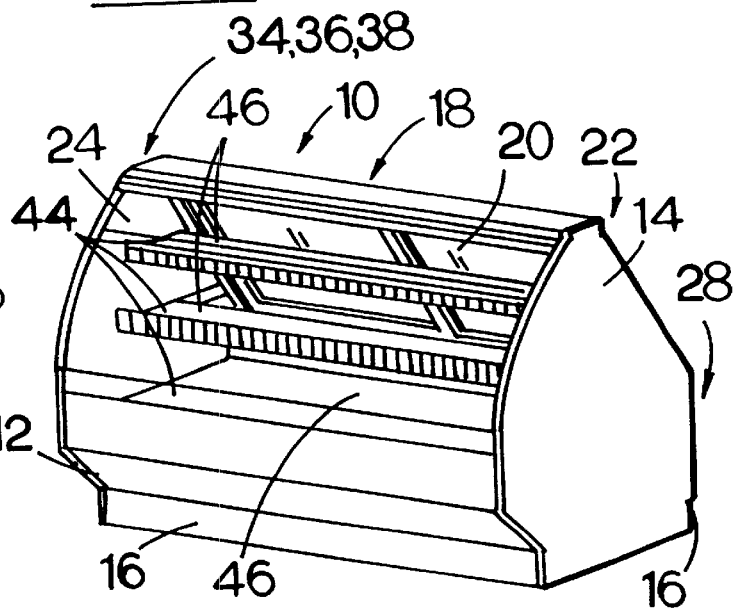
Figure 53:
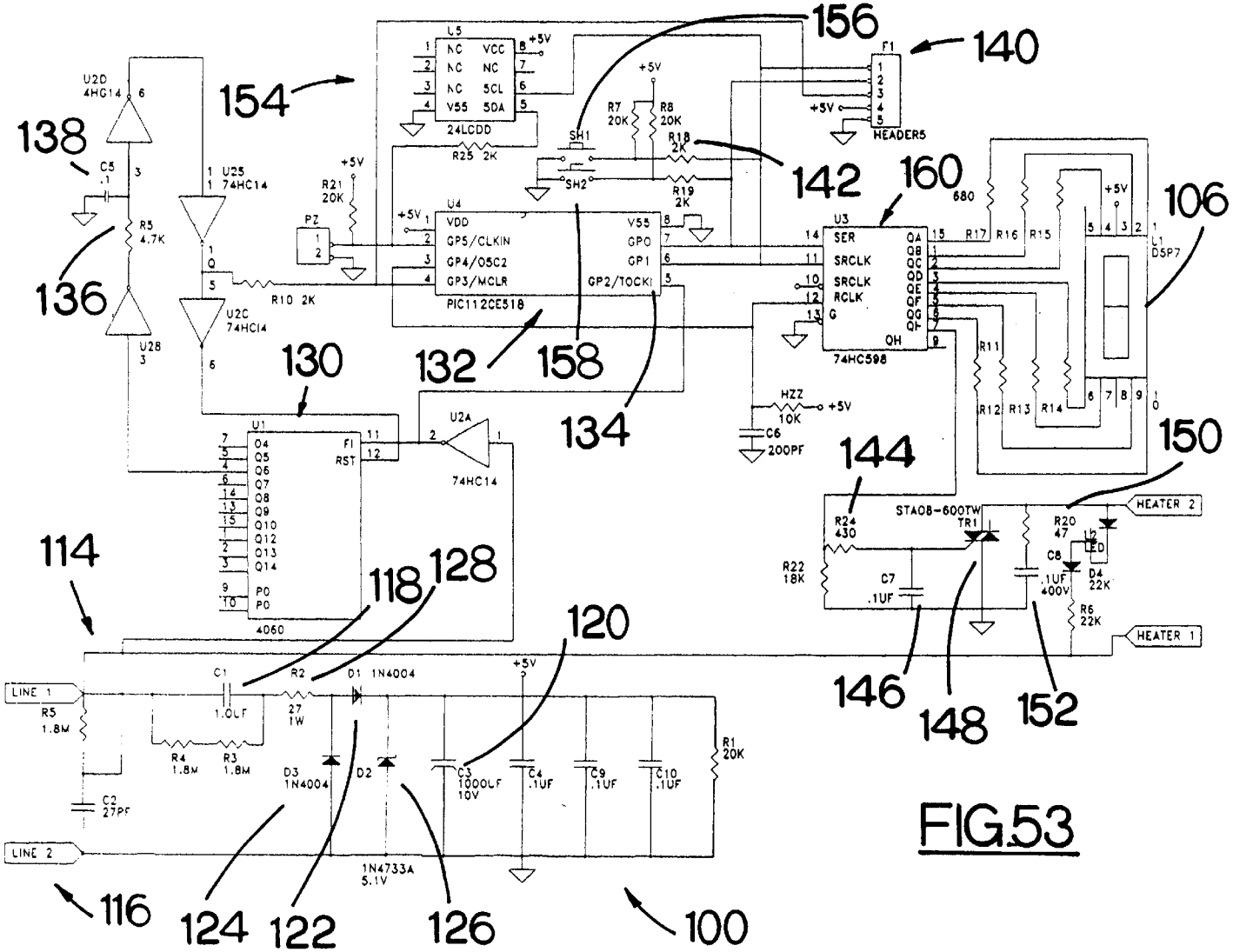
FIG. 53 is a schematic of a preferred embodiment of a temperature controller configured in accordance with this invention.
Figure 54:
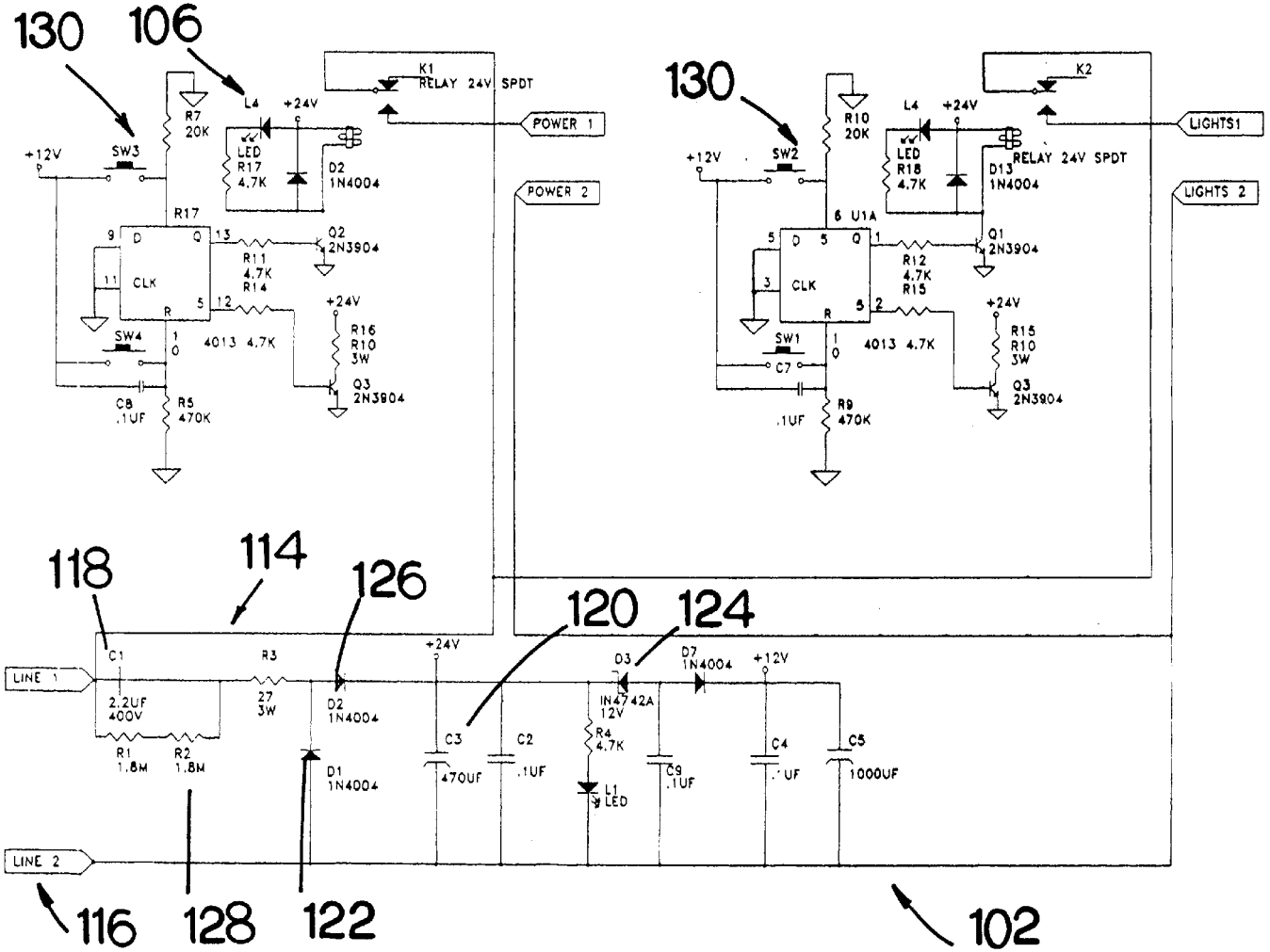
FIG. 54 is a schematic of a preferred embodiment of power panel switches configured in accordance with this invention.

While wells have been shown and described for the majority of preferred embodiments, FIGS. 50–52 illustrate a variation of this invention in which at least one thermal shelf and a thermal deck member are used in lieu of the wells and well arrangement.

This invention should now be understood by one skilled in the art. In the event that any questions or details remain, the following material is incorporated by reference and attached hereto as part of the disclosure of this invention:

Barker Company, Service and Installation Instructions for BMD-H, BSD-H, QHD Hot Series Display Cases; and Wiring diagrams for preferred embodiments of this invention, including BMD/SD 4, BMD/SD 6, BMD/SD 8 SERVICE, BMD 10 S OR S/S, BMD/SD 12 SERVICE.

Further information regarding the individual components of the display case or cases of this invention is described in the following documents incorporated by reference herein:

Standard Refrigeration and Electrical Replacement Parts List for:

BMD-12 12' SELF-CONT. MULTI-DECK DELI MERCHANDISER

BMD-12R 12' REMOTE MULTI-DECK DELI MERCHANDISER

BMD-4 4' SELF-CONT. MULTI-DECK DELI MERCHANDISER

BMD-4R 4' REMOTE MULTI-DECK DELI MERCHANDISER

BMD-6 6' SELF-CONT. MULTI-DECK DELI MERCHANDISER

BMD-6R 6' REMOTE MULTI-DECK DELI MERCHANDISER

BMD-8 8' SELF-CONT. MULTI-DECK DELI MERCHANDISER

BMD-8R 8' REMOTE MULTI-DECK DELI MERCHANDISER

BSD-12R 12' REMOTE SINGLE DECK DELI MERCHANDISER

BSD-4R 4' REMOTE SINGLE DECK DELI MERCHANDISER

BSD-6R 6' REMOTE SINGLE DECK DELI MERCHANDISER

BSD-8R 8' REMOTE SINGLE DECK DELI MERCHANDISER

From the foregoing description those skilled in the art will appreciate that all of the objects of the present invention are realized. A display case has been shown and described that is adapted to maintain food within a predetermined temperature range. With the merchandiser, heat source and controller of this invention heat distribution is more even and power consumption is reduced when compared to conventional equipment constructed for the same purpose.

The improved hot food display case or merchandiser apparatus is constructed to provide more uniform heat distribution to thus provide more uniform heating of food within case or apparatus to thereby substantially reduce any over-cooking of the food placed on the heat source. The hot food display case or merchandiser apparatus provides heat from both above and below food placed within the case of apparatus and the heating elements provide a more efficient long wave energy heat source.

The percentage controller of this invention provides improved uniformity in the source of heat and control of the heat output from the heat source. The percentage controller incorporates primary line noise control and suitable voltage reduction without an unnecessary feedback loop.

The improved hot food display case or merchandiser apparatus incorporates design flexibility as to heat source location, control and case or apparatus configuration and appearance. The construction of this invention allows for a variety of heat source locations and associated controls, that is, the number of hot "wells" may be selected to suit the application (e.g., grocery store, delicatessen, convenience food store), as illustrated in the accompanying drawing figures.

The solid state percentage controller of this invention in combination with a poured heat element uses less energy as the entire heat element incorporated in this invention is alternately energized and de-energized and maintains a uniform temperature without the hot spots that can be created with conventional heating rod technology.

Having described the display case and the percentage controller invention in detail, those skilled in the art will appreciate that modifications may be made of the display case and the percentage controller invention without departing from its spirit. Therefore, it is not intended that the scope of this invention be limited to the specific embodiments illustrated and described, rather, it is intended that the scope of the display case and the percentage controller invention be determined by the appended claims and their equivalents.

What is claimed is:

1. A display case comprising:

a case member, wherein the case member comprises a front panel, a rear panel, at least one well wherein the well has at least one heating element, and an upper support structure comprising a door slide that supports one or more sliding doors and a support structure extending from the upper member of the display case; and a solid state percentage controller having at least one control panel connected to a percentage control system wherein the control panel has digital controls providing control of input and output of the percentage control system wherein a logic operation voltage supply in the percentage control system is powered by a power supply comprising at least one capacitor, at least one rectifier, at least one zener diode, and at least one resistor.

2. The display case as set forth in claim 1 further comprising one or more upper heating elements in the upper support member.

3. The display case as set forth in claim 1 further comprising a shelf having a shelf heating element in the upper support member.

4. The display case as set forth in claim 1 wherein the case member has a display case light.

5. The display case as set forth in claim 1 wherein the case member has one or more upper heating elements manufactured from an infrared emitting material.

6. The display case as set forth in claim 5 wherein the upper heating element has two surfaces and an intersection between the two surfaces, the intersection between the two surfaces forms an obtuse angle.

7. The display case as set forth in claim 5 wherein the intersection between the two surfaces forms a substantially 120-degree angle.

8. The display case as set forth in claim 5 wherein the upper heating element has a generally convex shape.

9. The display case as set forth in claim 5 wherein the upper heating element has a generally concave shape.

10. The display case as set forth in claim 1 wherein the percentage control system controls the heating element output by alternating current from an on/off percentage control having a desired timing interval.

11. The display case as set forth in claim 10 wherein the timing of the fixed timing interval is based on multiple line frequency with approximately a zero cross firing angle.

12. The display case as set forth in claim 1 wherein the percentage control system controls the heating element output by alternating current from an on/off percentage control including direct voltage chopping whereby alternating current voltage is first converted to direct current voltage and then is delivered to the heating element by conventional circuitry.

13. The display case as set forth in claim 1 wherein the percentage control system controls the heating element output by alternating current from an on/off percentage control including firing at a fixed angle at every incoming power cycle and zero crossing detection for firing at 90 and 270 degrees.

14. The display case as set forth in claim 1 further comprising a case member wherein the percentage control system includes a power panel front panel having a light emitting device and at least one button whereby the operator can manually adjust a setting on the percentage control system.

15. The display case as set forth in claim 14 further comprising a cycle counter in the percentage control system counting every incoming cycle from a power line where the count is registered into a processor through a pin whereby the processor controls the incoming power based on the number of incoming cycles.

16. The display case as set forth in claim 15 wherein the cycle counter controls the power to output terminals in the percentage control system where the output terminals include at least one resistor, at least one capacitor, and at least one transistor.

17. The display case as set forth in claim 14 further comprising an EEPROM wherein the processor reads a setting value from the EEPROM and the setting is converted into an internal value and a corresponding mapped number is shown on the light emitting device.

18. The display case as set forth in claim 14 further comprising a case member wherein a data latch in the solid state percentage controller controls the light emitting device and a power output stage.

19. A display case comprising:

a case member, wherein the case member comprises a front panel, a rear panel, at least one well wherein the well has at least one heating element, and an upper support structure comprising a door slide that supports one or more sliding doors and a support structure extending from the upper member of the display case;

a solid state percentage controller having at least one control panel connected to a percentage control system wherein the control panel comprises digital controls providing control of input and output of the percentage control system and a cycle counter, where the cycle counter counts any incoming cycles from a power supply, the power supply comprising at least one capacitor, at least one rectifier, at least one zener diode, and at least one resistor; and a processor, where the processor registers a number of cycles, transfers any data from the processor to the percentage controller, controls the alternating current power to an electrical heating element connected with the percentage controller, and delivers a fixed-percentage output power to the electrical heating element based on a programmed setting.

20. A display case comprising a case member, wherein the case member comprises a front panel, a rear panel, a thermal deck member in a lower portion of the case member, and an upper support structure comprising a door slide that supports one or more sliding doors, a support structure extending from the upper member of the display case, and at least one thermal shelves in a portion of the upper support structure; and a solid state percentage controller having at least one control panel connected to a percentage control system wherein the control panel has digital controls providing control of input and output of the percentage control system wherein a logic operation voltage supply in the percentage control system is powered by a power supply comprising at least one capacitor, at least one rectifier, at least one zener diode, and at least one resistor.

21. The method of manufacturing and installing the upper heating element comprising:

casting the upper heating element into a suitable mold; and removing the upper heating element from the suitable mold; and installing the upper heating element in the upper support structure of the case member whereby any long wave radiation emission from the upper heating element is directed toward the food in the display case; and a solid state percentage controller controls the upper heating element output.

22. The method of maintaining a uniform temperature in a display case with a percentage controller comprising:

counting any incoming cycles from a power line with a cycle counter;

registering a number of cycles into a processor;

transferring any data from the processor to the percentage controller, where the percentage controller is powered by a logic operation voltage supply;

controlling the alternating current power to an electrical heating element connected with the percentage controller;

delivering a fixed-percentage output power to the electrical heating element based on a programmed setting value; and controlling a heating element output.

23. The method of maintaining a uniform temperature in a display case as set forth in claim 22 further comprising the steps of a processor in the percentage controller;

reading a programmed setting value from an EEPROM on the processor;

monitoring two push buttons and adjusting the setting value according to the changes in the push buttons by writing any new value into the EEPROM;

converting the setting value into an internal setting value;

showing a corresponding mapped number on the light emitting device; and turning off the power output circuitry when the number of incoming cycles is equal to the internal setting value.

24. The method of maintaining a uniform temperature in a display case as set forth in claim 22 further comprising the steps of a cycle counter in the percentage controller:

reaching an internal setting value;

routing a signal to a reset pin on the processor;

resetting the cycle counter by at least one resistor and at least one capacitor creating a sufficiently long reset pulse; and restarting the cycle count to count from the beginning.

* * * * *